US009656217B2

(12) United States Patent
Jeong

(10) Patent No.: US 9,656,217 B2
(45) Date of Patent: May 23, 2017

(54) DISPERSER

(71) Applicant: Wook-do Jeong, Busan (KR)

(72) Inventor: Wook-do Jeong, Busan (KR)

( * ) Notice: Subject to any disclaimer, the term of this patent is extended or adjusted under 35 U.S.C. 154(b) by 0 days.

(21) Appl. No.: 15/033,059

(22) PCT Filed: Aug. 27, 2014

(86) PCT No.: PCT/KR2014/007977

§ 371 (c)(1),
(2) Date: Apr. 28, 2016

(87) PCT Pub. No.: WO2015/064904

PCT Pub. Date: May 7, 2015

(65) Prior Publication Data

US 2016/0279583 A1 Sep. 29, 2016

(30) Foreign Application Priority Data

Nov. 1, 2013 (KR) ..... 10-2013-0131907

(51) Int. Cl.
*B01F 3/04* (2006.01)

(52) U.S. Cl.
CPC *B01F 3/04539* (2013.01); *B01F 2003/04546* (2013.01); *B01F 2003/04567* (2013.01)

(58) Field of Classification Search
CPC ..... B01F 3/04539; B01F 2003/04546; B01F 2003/04567
USPC ..... 261/91, 93
See application file for complete search history.

(56) References Cited

U.S. PATENT DOCUMENTS

| | | | | |
|---|---|---|---|---|
| 720,513 | A * | 2/1903 | Cheney | B01F 3/04539 261/87 |
| 2,928,665 | A * | 3/1960 | Epprecht | B01F 3/04539 261/87 |
| 5,226,727 | A * | 7/1993 | Reichner | B01F 3/04035 366/170.3 |
| 6,712,980 | B1 * | 3/2004 | Ahlstrom | B01F 3/04539 210/629 |
| 2010/0110824 | A1 * | 5/2010 | Hirata | B01F 3/04539 366/133 |

FOREIGN PATENT DOCUMENTS

| | | | |
|---|---|---|---|
| KR | 10-2011-0136313 | A | 12/2011 |
| KR | 10-1152746 | B1 | 6/2012 |

* cited by examiner

*Primary Examiner* — Charles Bushey
(74) *Attorney, Agent, or Firm* — Innovation Counsel LLP

(57) ABSTRACT

Disclosed herein is a disperser which can be easily installed without any air pump, a transfer pope and a porous disperser in such a way to install an impeller, which is employed to discharge water and at the same time to suck air, at an end portion after a shaft employed to transfer the driving force of a driving motor has been connected underwater, wherein the disperser of the present inventive concept is easy to maintain without cleaning due to the plugging, whereupon maintenance is easy and the applicability of the product is good.

12 Claims, 11 Drawing Sheets

DISPERSER

CROSS-REFERENCE TO RELATED APPLICATION

This application claims priority to and the benefit of PCT Patent Application PCT/KR2014/007977 filed in the Korean Intellectual Property Office on Aug. 27, 2014, which claims priority to Korean Patent Application No. 10-2013-0131907 filed in the Korean Intellectual Property Office on Nov. 1, 2013, the entire contents of which are incorporated herein by reference.

BACKGROUND (a) Technical Field

The present inventive concept relates to a disperser which is able to disperse air in water, and in particular to a disperser which is able to generate a bubble jet stream in water with a higher efficiency as compared to electric power consumption without any loss in terms of driving force which may occur due to suction.

(b) Background Art

A primary method for aerating (dispersing) a gas (air, oxygen, etc.) in water may be carried out, for example, in such a way that the gas compressed with an air pump is supplied to a porous disperser via a transfer pipe, which in general is being employed where water is shallow and an air dispersion area is not wide.

As a conventional disperser, the aerator (Korean patent laid-open No. 1152746) includes a casing which is fixedly installed on the floor in such a way to be submerged at a portion of the inside of a reaction tank of a water treatment apparatus and is formed of an inlet passage the top of which is open, and an outlet passage formed inclined downward; an air supply pipe which is supporting an outer portion of the casing and is formed of an air supply port communicating with a central portion of the inside of the casing via a lower portion of the casing; a conical diffuser which is covered on the top of the air supply port of the air supply pipe and is fixedly installed at a lower portion of the inside of the casing and is configured to accommodate a predetermined amount of air of the air supply port and has a bubble discharge hole, wherein an outer circumferential surface of a lower portion of the inside thereof is open in order for the air, which is continuously supplied via the air supply pipe, to be exhausted downward; an impeller which is engaged rotatable to an upper portion of the diffuser inside the casing and is employed to receive waste water of the upper portion of the casing and mix and discharge the waste water downward, while spreading and dispersing the bubbles which are generated by the diffuser during the discharge thereof; and a driving motor which is able to drive the impeller and is disposed integral with the impeller and is fixedly installed at the top of the casing. The diffuser of the aforementioned aerator is provided with the diffuser wherein a plurality of holes are disposed at regular intervals at a side surface of the conical configuration without any bubble discharge holes at a lower portion of the conical configuration.

As another conventional disperser, the disperser (Korean patent registration No. 2010-0056215) includes a shaft which is configured to rotate by the driving of a motor; a plurality of rotors which are installed horizontally at a lower portion of the shaft; an impeller which is installed at the tops of the rotors; a case which is provided to accommodate the impeller and the rotors, and a separation housing which is installed at an upper portion of the case, wherein a space part is formed at a lower portion thereof, and an inlet groove is formed in a circumferential direction at the top of the space part, and a retrieval pipe is formed at a portion of the inlet groove, wherein a plurality of slits are formed over a surface from a portion of the shaft at the space part of the separation housing to a portion of the top of the impeller in the configuration of the shaft which is installed passing through the separation housing and the impeller.

The aforementioned conventional dispersers and other dispersers have problems, for example, water pressures are too high where water is deep and an air dispersion area is wide, and a very strong air pump should be used, which is able to generate air high enough to exceed the resistance pressures of the pipe and porous disperser. Moreover, the transfer pipes should be installed underwater, and it is hard to select an efficient disperser, and maintenance may be hard due to the plugged porous holes.

SUMMARY OF THE DISCLOSURE

The present inventive concept has been made in an effort to solve the above-described problems associated with prior art.

It is an object of the present inventive concept to provide a disperser which can be easily installed without any air pump, a transfer pope (a hollow shaft) and a porous disperser in such a way to install an impeller, which is employed to discharge water and at the same time to suck air, at an end portion after a shaft employed to transfer the driving force of a driving motor has been connected underwater, wherein the disperser of the present inventive concept is easy to maintain without cleaning due to the plugging, whereupon maintenance is easy and the applicability of the product is good.

To achieve the above object, there is provided a disperser which may include, but is not limited to, a driving motor, a hollow shaft, one end portion of the hollow shaft is connected to the driving motor and is configured to be rotated by the driving motor, and an impeller which is disposed on an opposite end portion of the hollow shaft and is employed to discharge air to the outside of the dispenser, a rotary joint connecting the one end portion of the hollow shaft to the driving motor, wherein the impeller includes a circular plate-shaped body having a plurality of wings at a lower surface thereof, and an upper circular plate-shaped guide wing and a lower circular plate-shaped guide wing disposed at the upper and lower portions of the body, respectively, and a plurality of suction ports formed through the lower circular plate-shaped guide wing, the edges of the upper circular plate-shaped guide wing and the lower circular plate-shaped guide wing are bent at predetermined angle toward the circular plate-shaped body.

The rotary joint may include a hollow rotation body to which an upper end portion of the hollow shaft is connected and a fixed body which surrounds an outer surface of the rotation body, and through holes formed to pass through inner centers of the rotation body and the fixed body.

The predetermined angle may be from about 25° to about 30°.

A center of the lower circular plate-shaped guide wing may have a concave shape when viewed from the top.

The disperser may further include a floating device connected to the driving motor by a connection member.

The floating device may include a central plate connected to the connection member, a plurality of rods connected to the central plate and a floating body connected to the plurality of rods.

The central plate may include a central hole formed at a center of the central plate.

The central plate may further include a cut-away hole extending from the central hole to an edge of the central plate.

The floating body may further include a rod insertion hole form on a top portion of the floating body and a connection cap having a rod mounting groove on a top portion of the floating body.

The floating device may further include a guide plate connected to the central plate by supporting rods.

The floating device may further include a fixing plate connected to the central plate to fix the hollow shaft not to detach from the central plate.

The disperser may further include an engaging member connecting the hollow shaft to an auxiliary hollow shaft.

The disperser according to the present inventive concept has a simplified configuration. A water suction force via a suction port is good since a central portion of a lower guide wing is formed concave, and the central portion becomes a vacuum state with the aid of centrifugal force during the rotation of a guide wing, and the guide wing can be easily attached and detached, and the fluid discharged from the impeller can be dispersed upward or downward or up to a near or distant area, and applicability on site can be maximized.

BRIEF DESCRIPTION OF THE DRAWINGS

The above and other features of the present inventive concept will now be described in detail with reference to certain exemplary embodiments thereof illustrated the accompanying drawings which are given hereinbelow by way of illustration only, and thus do not limit the present inventive concept, and wherein.

Figure 1:
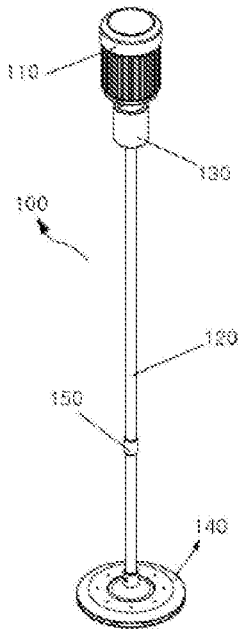
FIG. 1 is a perspective view illustrating a disperser according to the present inventive concept.

It should be understood that the appended drawings are not necessarily to scale, presenting a somewhat simplified representation of various preferred features illustrative of the basic principles of the inventive concept. The specific design features of the present inventive concept as disclosed herein, including, for example, specific dimensions, orientations, locations, and shapes will be determined in part by the particular intended application and use environment.

In the figures, reference numbers refer to the same or equivalent parts of the present inventive concept throughout the several figures of the drawing.

DETAILED DESCRIPTION

The disperser 100 according to the present inventive concept may include, but is not limited to, a driving motor 110; a hollow shaft 120 which is configured to rotate by the driving motor 110; and an impeller 140 which is installed at a lower end portion of the hollow shaft 120 and is employed to discharge air which is inputted into the hollow shaft 120 to the outside of the disperser 100, wherein the driving motor 110 and the hollow shaft 120 are coupled by a rotary joint 130, and an upper portion of the rotary joint 130 is connected to a driving shaft 111 of the driving motor 110, the rotary joint 130 comprises a hollow rotation body 131 to which an upper end portion of the hollow shaft 120 is connected and which is disposed at an inner portion thereof and is configured to rotate together with the hollow shaft 120, and a fixed body 132 which is installed at an outer portion of the rotation body 131, and the fixed body 132 cannot rotate, and through holes 131*a* and 132*a* formed through inner centers are formed at the lateral surfaces of the rotation body 131 and the fixed body 132, thus inputting external air into the hollow shaft 120.

Moreover, the impeller 140 may include, but is not limited to, a circular plate-shaped body 141 wherein a plurality of wings 144 are disposed in a circumferential direction at a lower surface thereof. Upper and lower circular plate-shaped guide wings 142 and 143 are engaged to the upper and lower portions of the circular plate-shaped body 141. A plurality of suction ports 145 are formed at the lower guide wing 143 while passing through from top to bottom of the lower circular plate-shaped guide wing 143.

Furthermore, the edges of the upper and lower guide wings 142 and 143 are bent at predetermined angles toward the circular plate-shaped body 141.

The disperser according to the present inventive concept will be described in details with reference to the accompanying drawings.

Figure 2:
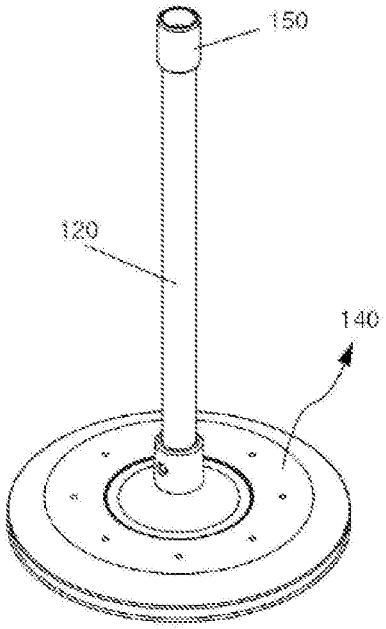
FIG. 2 is a perspective view illustrating a hollow shaft and an impeller of a disperser according to the present inventive concept.
Figure 3:
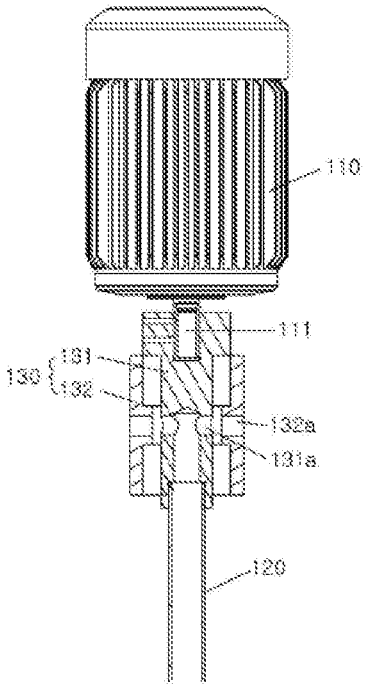
FIG. 3 is a view illustrating a rotary joint according to the present inventive concept.
Figure 4:
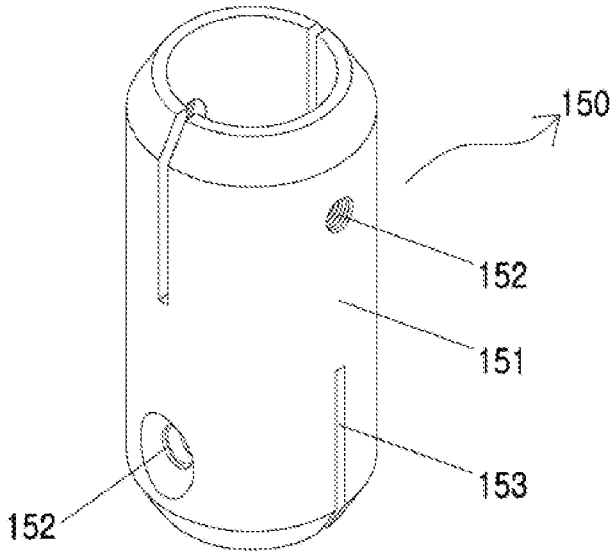
FIG. 4 is a perspective view illustrating an engaging member according to the present inventive concept.

FIG. 1 is a perspective view illustrating a disperser according to the present inventive concept, FIG. 2 is a perspective view illustrating a hollow shaft and an impeller of a disperser according to the present inventive concept, and FIG. 3 is a view illustrating a rotary joint according to the present inventive concept.

Referring to FIG. 1, the disperser 100 according to the present inventive concept may include, but is not limited to, a driving motor 110, and a hollow shaft 120 which is driven by the driving motor 100.

The hollow shaft 120 may be made of a metallic hollow pipe.

The hollow shaft 120 may be preferably made of a material SUS304 or SUS316 which has a good corrosion resistance and straightness.

Meanwhile, an impeller 140 is provided at an end portion of the hollow shaft 120 which is disposed to oppose the driving motor, wherein the impeller 140 is employed to discharge sucked air via the hollow shaft 120 to the outside of the disperser 100.

The driving motor 110 and the hollow shaft 120 are interconnected by the rotary joint 130.

The rotary joint 130 may include, but is not limited to, a rotation body 131 which is made in the form of a hollow body, wherein a driving shaft 111 of the driving motor 110 and a hollow shaft 120 are connected to both ends of the rotation body 131. The rotation body 131 can rotate with the driving shaft 111 and the hollow shaft 120. A fixed body 132 which is made in the form of a hollow body while accommodating the rotation body 131 within an inner concentric circle surrounds outer surface of the rotation body 131 and is configured not to interrupt the rotation of the rotation body 131. Through holes 131*a* and 132*a* are formed at the lateral portions of the rotation body 131 and the fixed body 132 to expose an inner hole of the rotary joint 130.

More specifically, the rotary joint 130 may include the rotation body 131 to both ends of which the driving shaft 111 and the hollow shaft 120 are connected, and the fixed body 132 which is fixed at an outer portion of the rotation body 131 and is configured not to interrupt the rotation of the rotation body, and the through holes 131*a* and 132*a* are formed at the lateral surfaces of the rotation body and the fixed body in the directions toward the inner center of the rotary joint 130.

Moreover, a space is formed between the rotation body and the fixed body. A bearing, etc. are provided for the sake of smooth rotation of the rotation body in a state where the rotation body and the fixed body are engaged together.

The bearing is a typical member, so it is not illustrated in the drawings.

External air can be inputted via the through hole 132*a* of the fixed body 132 with the aid of the rotation of the impeller. The external air can be inputted into the hollow shaft 120 via the space between the fixed body and the rotation body 131 and via the through hole 131*a* of the rotation body 131.

Meanwhile, since the driving motor 110, the rotation body 131 of the rotary joint and the hollow shaft 120 are configured to integrally rotate together, and the fixed body of the rotary joint does not rotate, a tube (not shown) won't be twisted even if the tube is engaged to the through hole 132*a* of the fixed body 132 so as to input a predetermined gas, for example, oxygen, nitrogen, etc., not the air, into the hollow shaft.

As illustrated in FIG. 1, the aforementioned disperser 100 according to the present inventive concept is preferred installed in a vertical posture in such a way that the driving motor 110 is disposed on outside of water, and the impeller 140 is disposed under the water.

More specifically, the driving motor is disposed at an upper portion which is out of the water, and the hollow shaft driven by the driving motor is installed upright in the downward direction, with an end portion thereof positioning under the water, and the impeller configured to discharge air inputted via the hollow shaft 120 into the water is disposed at an end portion of the hollow shaft 120.

Meanwhile, the length of the hollow shaft 120 can be extended at a place, where water is deep, in such a way to connect the hollow shafts using an engaging member 150.

The engaging member may be made of a metallic material or a synthetic resin material.

In the engaging member 150, a vertical cut-away groove 153 is formed at both ends of the housing 151 of the hollow body, and an engaging groove 152 into which an engaging member, for example, a bolt, a pin, etc. is inserted is provided at a lateral portion of the housing 151 which is disposed orthogonal to the cut-away groove 153.

The hollow shaft 120 is inserted into both ends of the housing 151, and a hole (not illustrated) of the hollow shaft is aligned with the engaging groove of the housing, and the bolt or the pin is passed through and engaged, and then the nut is tightened, thus interconnecting the hollow shafts.

When the bolt is passed through with the aid of the engaging groove formed at the housing 151, and the nut is tightened, the widened vertical cut-away groove 150 will be closed, thus reducing the diameter of the housing 151, whereupon the hollow shafts 120 can be more strongly covered.

Figure 5:
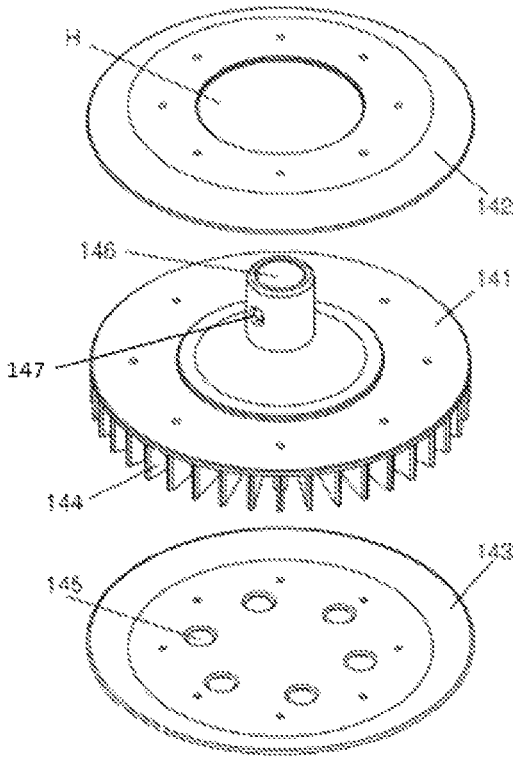
FIG. 5 is a disassembled perspective view illustrating an impeller of a disperser according to the present inventive concept.
Figure 6:
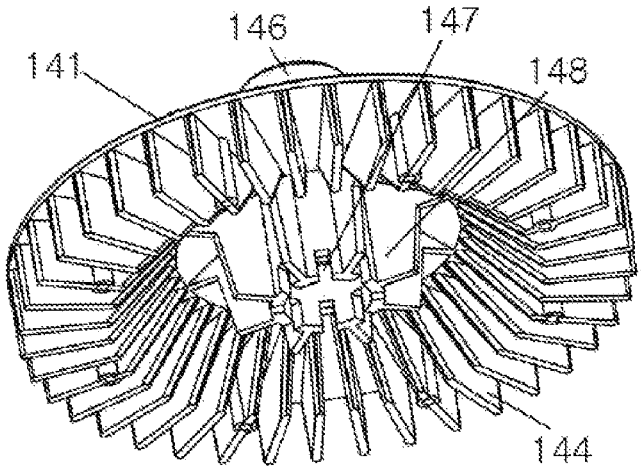
FIG. 6 is a perspective view illustrating an impeller body of a disperser according to the present inventive concept.
Figure 7:
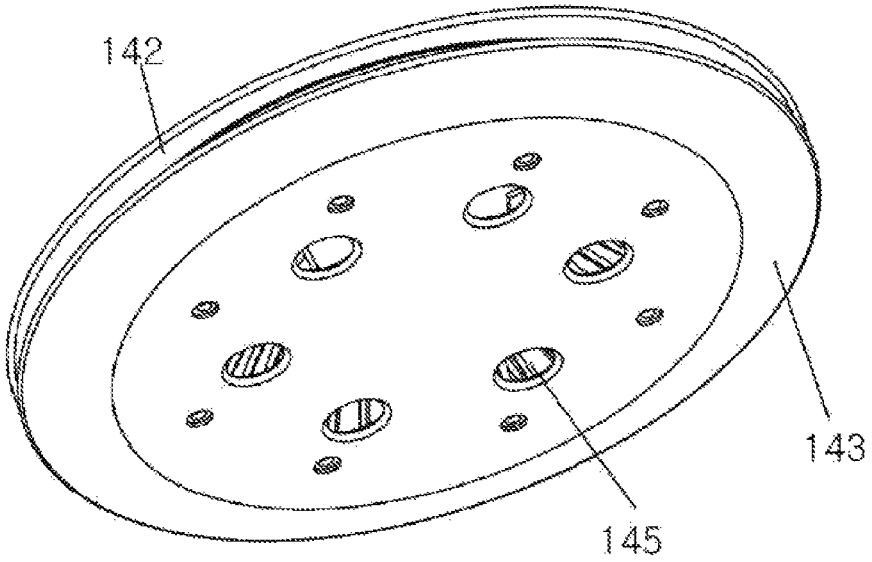
FIG. 7 is a perspective view illustrating an impeller when viewing from the bottom of the impeller according to the present inventive concept.

FIG. 5 is a disassembled perspective view illustrating an impeller of a disperser according to the present inventive concept, FIG. 6 is a perspective view illustrating an impeller body of a disperser according to the present inventive concept, and FIG. 7 is a perspective view illustrating an impeller when viewing from the bottom of the impeller according to the present inventive concept.

As illustrated in FIGS. 5 and 6, the impeller 140 of the disperser 100 according to the present inventive concept may include, but is not limited to, a circular plate-shaped body 141 wherein a plurality of wings 144 are disposed at a lower surface thereof in a circumferential direction, and upper and lower circular plate-shaped guide wings 142 and 143 which are installed at the upper and lower portions of the body 141. A plurality of suction ports 145 passing through from top to bottom are formed at the lower guide wing 143.

It is preferred that a plurality of the suction ports 145 are disposed at regular intervals in the circumferential direction.

A ventilation pipe 146 communicating with the hollow shaft 120 is provided at the top of the circular plate-shaped body 141, and a through hole 147 configured to receive air is formed at a lateral portion of the ventilation pipe 146, and a plurality of assistant wings 148 are formed at regular intervals in the circumferential direction at a lateral portion of the ventilation pipe 146, by means of which air can be more efficiently inputted.

Moreover, the wings 144 are disposed at regular intervals at the edges of the lower surface of the circular plate-shaped body 141, and the upper and lower guide wings 142 and 143 are provided at the upper and lower portions of the circular plate-shaped body 141.

More specifically, the impeller 140 according to the present inventive concept is configured in a dual structure which is formed of the wings 144 formed at the edges of the circular plate-shaped body 141 and the assistant wings 148 formed at an outer surface of the ventilation pipe 146. The assistant wings 148 formed at the ventilation pipe 146 are employed to assist in the input of air, and the wings 144 formed at the edges of the circular plate-shaped body 141 are employed to assist in the input of water and the discharge of air together.

The blades are formed in a radial direction by means of which the air inputted via the hollow shaft 120 and the water sucked via the suction ports 145 of the lower guide wing 143, which will be described later, can be efficiently discharged into water.

A hollow hole (H) through which the ventilation pipe 146 of the body can pass is formed in the center of the upper circular plate-shaped guide wing 142.

Moreover, the edges of the upper and lower circular plate-shaped guide wings 142 and 143 are bent at predetermined angle toward the circular plate-shaped body.

More specifically, the centers of the upper and lower circular plate-shaped guide wings 142 and 143 are formed horizontal, and the edges thereof are bent upward or downward at the angle of about 25°~about 30°.

As illustrated in FIG. 7, the center of the lower circular plate-shaped guide wing 143 may have a concave shape when viewed from the top.

The aforementioned configuration is employed to accelerate the input of the water into the impeller 140 via the suction ports 145 by forming a vacuum state in the central portion by means of the centrifugal force at the lower surface of the lower circular plate-shaped guide wing 143 during the rotations by the driving motor 110.

The impeller 140 is disposed at a lower portion of the hollow shaft 120 and will rotate together with the hollow shaft 120, by which air can be naturally discharged into water via the impeller 140.

The water can be also inputted via the suction ports 145 formed at the lower circular plate-shaped guide wing 143 and can be discharged together with the air in the form of bubble jet streams.

The impeller 140 is made of a reinforced plastic material consisting of a nylon-66 and a glass fiber at a ratio of 7:3.

FIGS. 8 to 11 are views illustrating the spraying directions which are determined based on the engaging directions of the circular plate-shaped guide wings 142 and 143 of the disperser 100 according to the present inventive concept.

In FIGS. 8 to 11, the character (A) represents the flow of air, and (W) represents the flowing direction of water.

Figure 8:
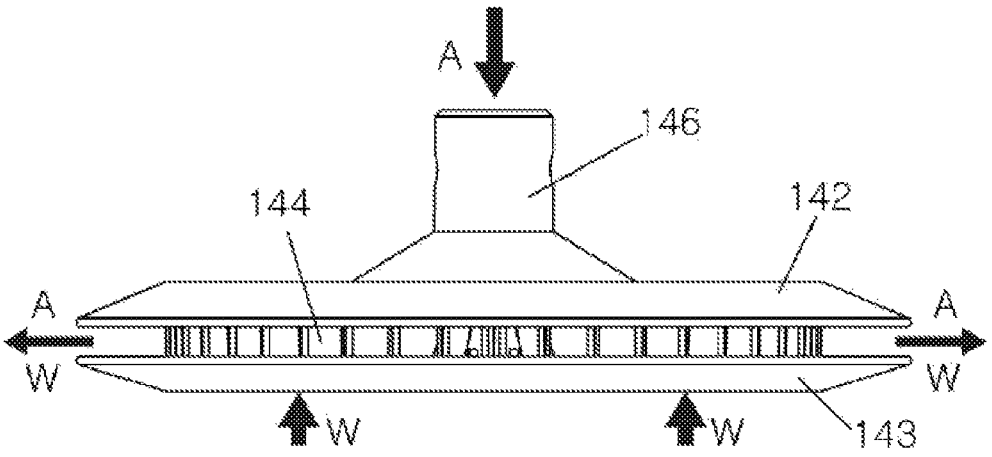
FIGS. 8, 9, 10 and 11 are views illustrating the spraying directions based on an engaging direction of a guide wing of a disperser according to the present inventive concept.
Figure 9:
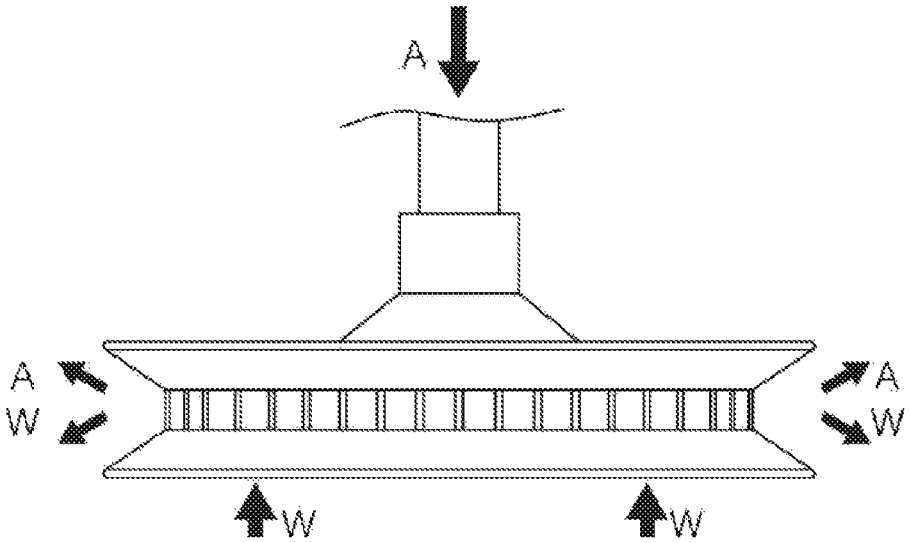

As illustrated in FIG. 8, the bent direction of the upper circular plate-shaped guide wing 142 is facing downward, and the bent direction of the lower circular plate-shaped guide wing 143 is facing upward, by means of which the discharging area can be narrowed, thus allowing the air to be more strongly discharged, whereby the air can be more efficiently discharged up to a distant area. As illustrated in FIG. 9, if the bent direction of the upper circular plate-shaped guide wing 142 and the bent direction of the lower circular plate-shaped guide wing 143 are facing upward and downward, respectively, the area of the discharging is wide, by means of which the air can be weakly discharged, whereupon the air cannot be discharged up to a distant area.

Figure 10:
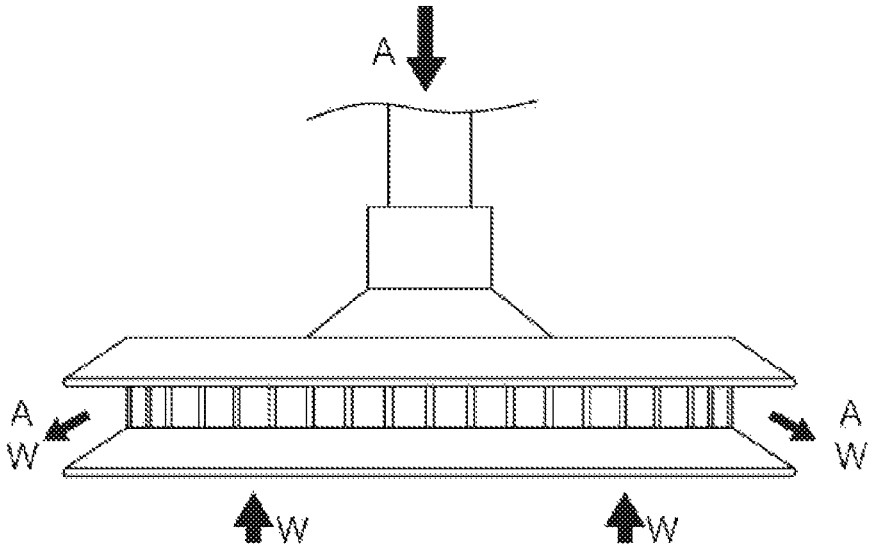
Figure 11:
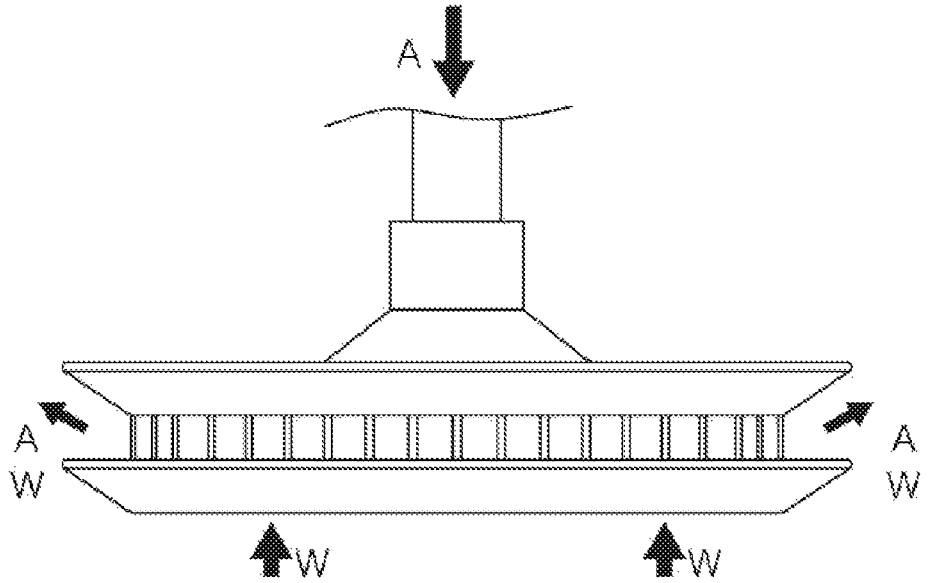

As illustrated in FIGS. 10 and 11, if the bent directions of the upper and lower circular plate-shaped guide wings 142 and 143 are same, facing either upward or downward, the discharging direction of the air can be an upward direction or a downward direction.

Figure 12:
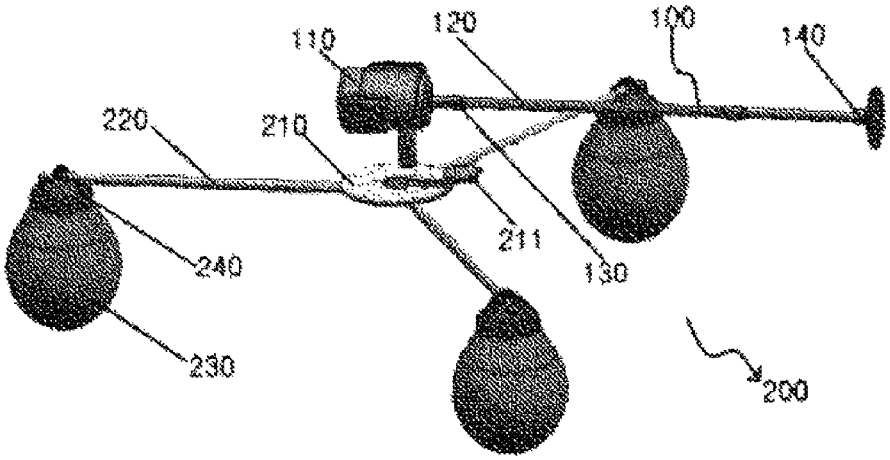
FIG. 12 is a view for describing the use of a floating device for a disperser according to the present inventive concept.
Figure 13:
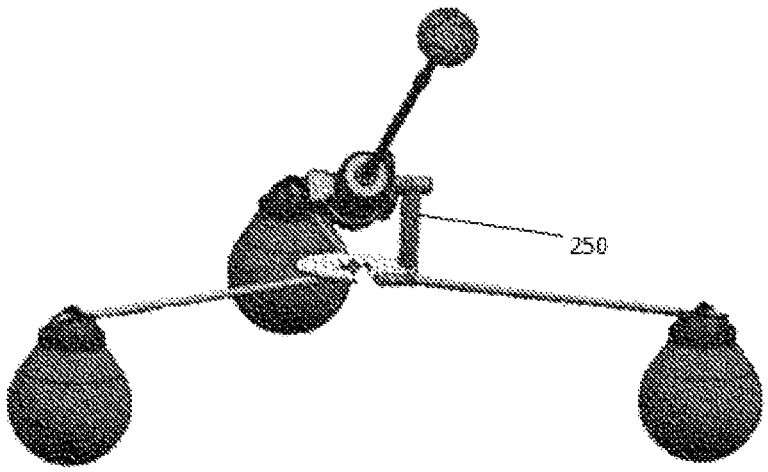
FIG. 13 is a perspective view illustrating another configuration in FIG. 12.
Figure 14:
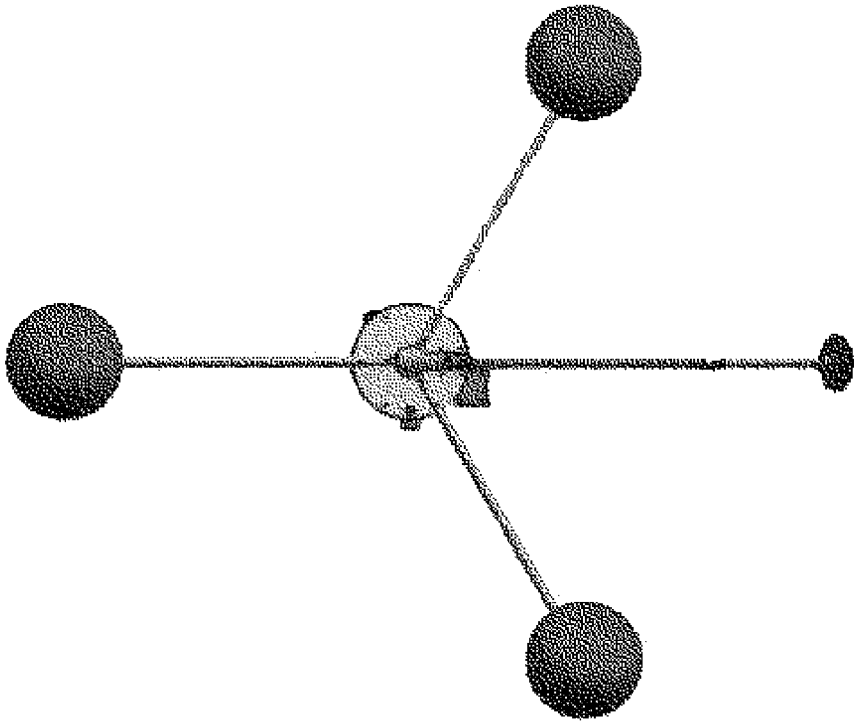
FIG. 14 is a rear view illustrating a floating device.
Figure 15:
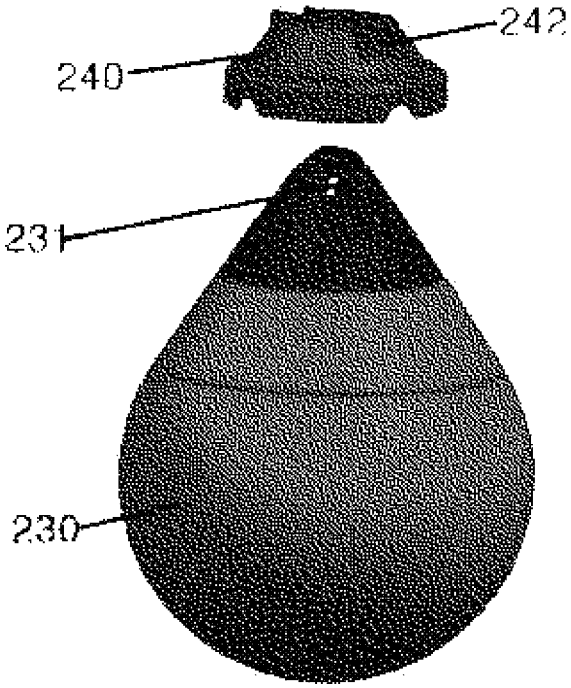
FIG. 15 is an enlarged view illustrating a floating body of a floating device for a disperser according to the present inventive concept.
Figure 16:
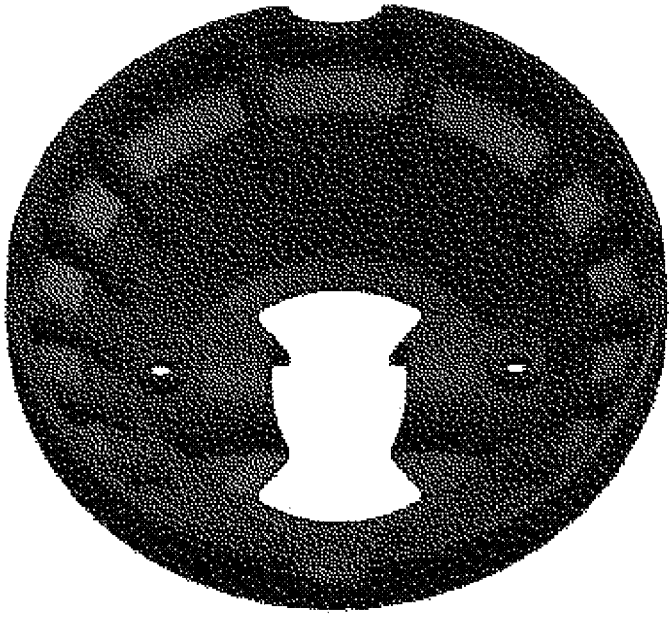
FIG. 16 is a bottom view illustrating a connection cap which is engaged to a floating device.
Figure 17:
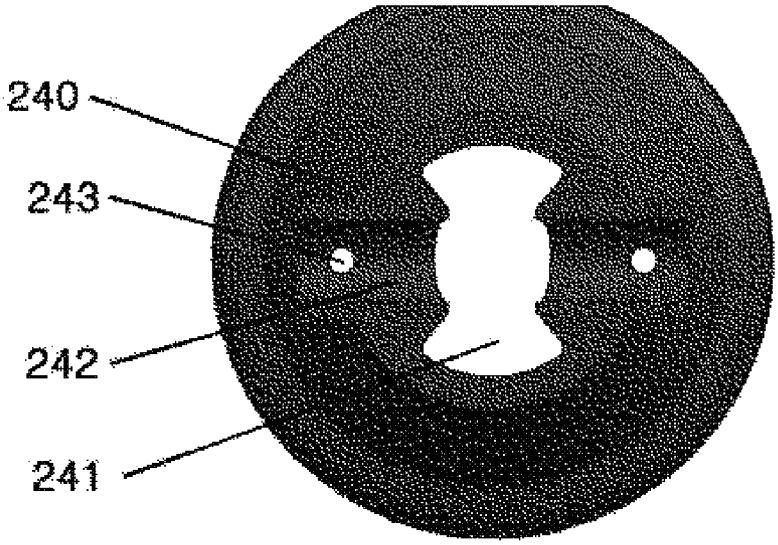
FIG. 17 is a plane view illustrating a connection cap which is engaged to a floating device.
Figure 18:
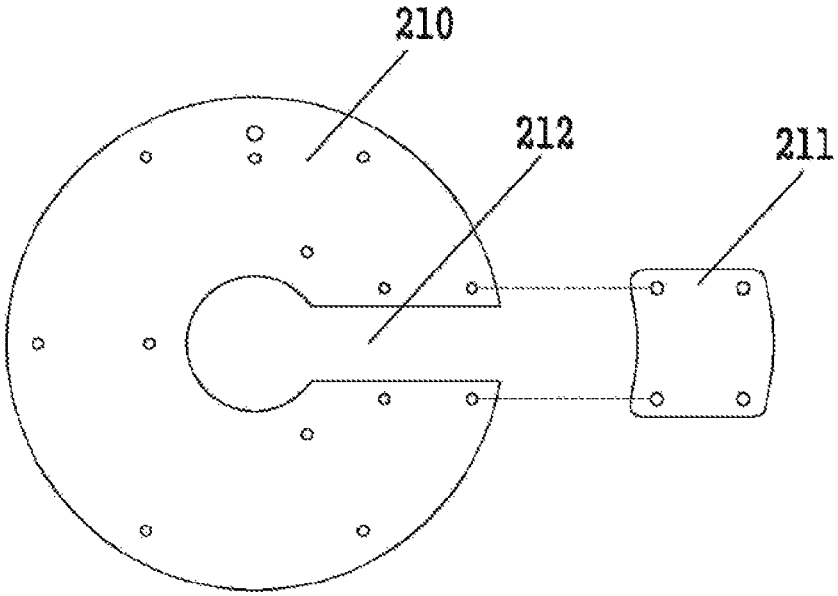
FIG. 18 is a plane view illustrating a central plate of a floating device.
Figure 19:
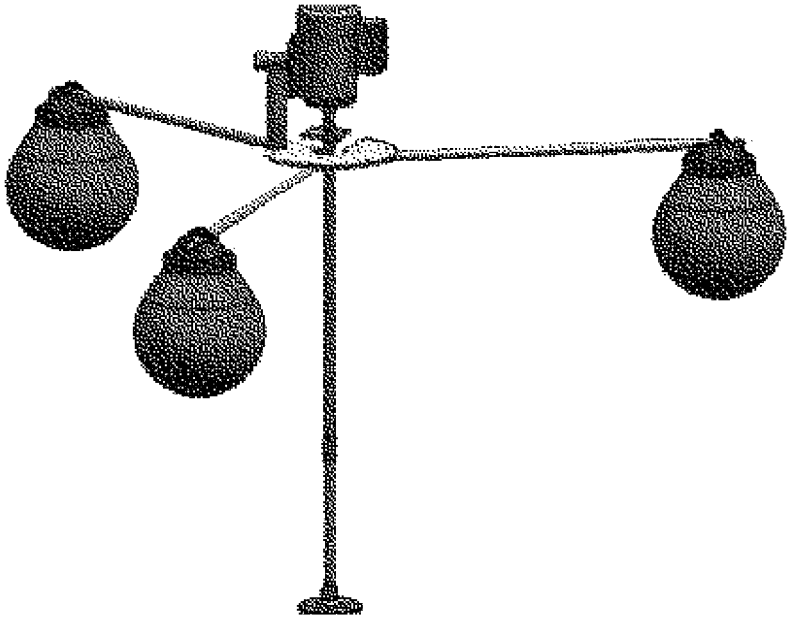
FIG. 19 is a view illustrating a state where a hollow shaft of a disperser positions below a central plate.
Figure 20:
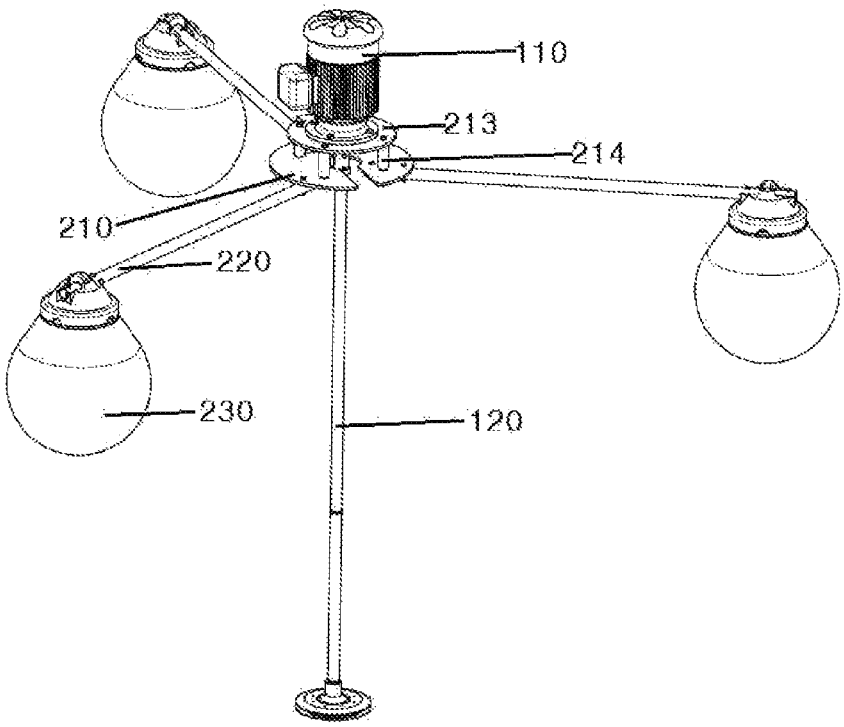
FIG. 20 is a perspective view another example of a floating device according to the present inventive concept.
Figure 21:
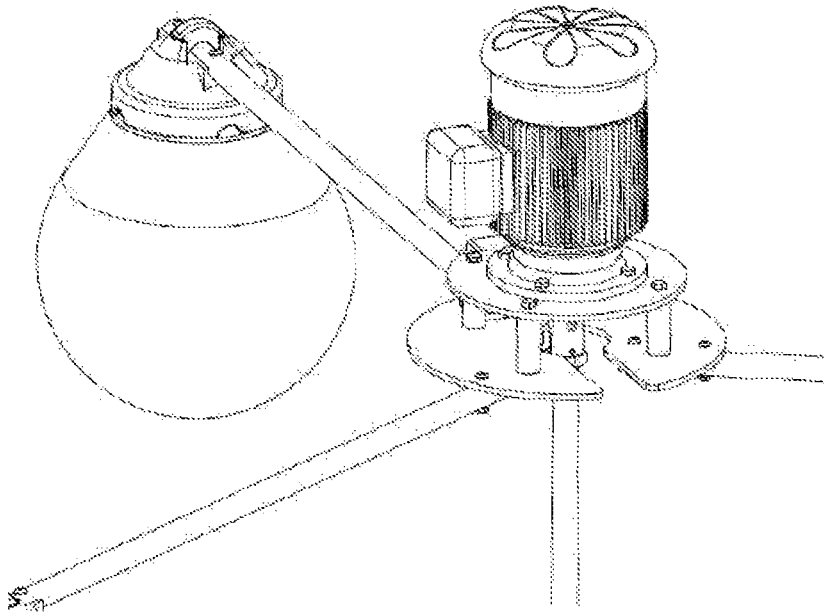
FIG. 21 is a partially enlarged view illustrating an upper portion of a floating device according to another embodiment of the present inventive concept.
Figure 22:
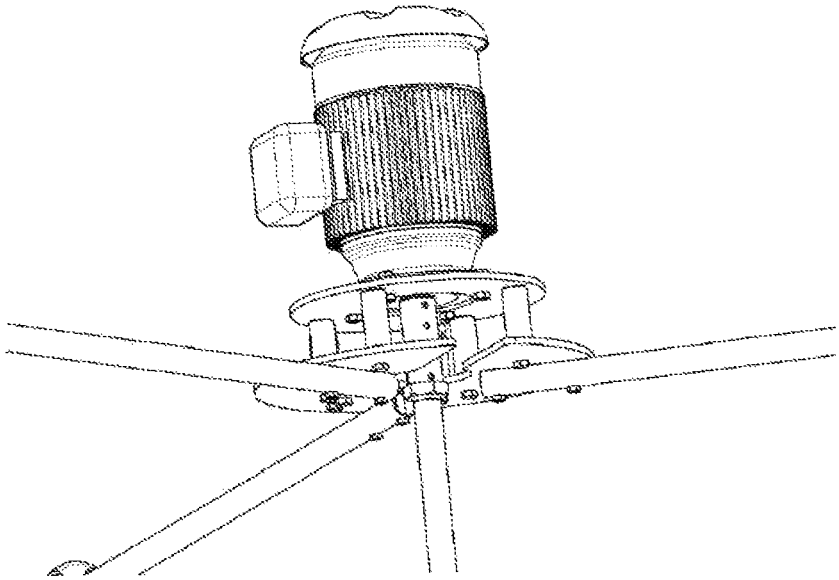
FIG. 22 is a partially enlarged view illustrating a lower portion of a floating device according to another embodiment of the present inventive concept.

FIG. 12 is a view for describing the use of a floating device for a disperser according to the present inventive concept, FIG. 13 is a perspective view illustrating another configuration in FIG. 12, FIG. 14 is a rear view illustrating a floating device, FIG. 15 is an enlarged view illustrating a floating body of a floating device for a disperser according to the present inventive concept, FIG. 16 is a bottom view illustrating a connection cap which is engaged to a floating device, FIG. 17 is a plane view illustrating a connection cap which is engaged to a floating device, FIG. 18 is a plane view illustrating a central plate of a floating device, FIG. 19 is a view illustrating a state where a hollow shaft of a disperser positions below a central plate, FIG. 20 is a perspective view another example of a floating device according to the present inventive concept, FIG. 21 is a partially enlarged view illustrating an upper portion of a floating device according to another embodiment of the present inventive concept, and FIG. 22 is a partially enlarged view illustrating a lower portion of a floating device according to another embodiment of the present inventive concept.

The floating device for a disperser 100 according to the present inventive concept is engaged to the disperser 100 which is able to aerate air in water, whereby the disperser 100 can float on the seawater. The disperser 100 which is intended to be engaged to the floating device of the disperser according to the present inventive concept will be first described.

As illustrated in FIG. 12, the disperser 100 may include, but is not limited to, a driving motor 110, a hollow shaft 120 formed in a hollow body shape which may be rotated by the driving motor 110, and an impeller 140 which is installed at a lower portion of the hollow shaft 120 and is employed to discharge to the outside the air which is inputted into the hollow shaft 120.

The driving motor 110 and the hollow shaft 120 are engaged by a rotary joint. The upper portion of the rotary joint is connected to the driving shaft of the driving motor 110, and the lower portion thereof is formed of a rotation body made in the form of a hollow body to an upper portion of which the hollow shaft is connected and which is configured to rotate together, and a fixed body installed at an outer portion of the rotation body. The fixed body is not rotatable. Through holes allowing external air to move into the inside of the hollow shaft are formed at the lateral portions of the rotation body and the fixed body while passing through the inner centers thereof.

The floating device 200 for a disperser according to the present inventive concept may include, but is not limited to, a central plate 210 to an upper surface of which the disperser 100 is engaged, a plurality of rods 220 which are engaged in a radial shape to the central plate 210, and a floating body 230 which is engaged to the rods 220.

Moreover, the central plate 210 is formed in a plate shape, and a cut-away hole 212 is formed in a radius direction. The horizontal cross section thereof is formed in a shape of ⊖. The cut-away hole 212 is employed to allow the hollow shaft 120 of the disperser 100 to easily rotate in the downward direction of the central plate 210 when the disperser 100 is engaged to the upper surface of the central plate 210.

Furthermore, the fixed plate 211 is engaged detachable to the edge of the central plate wherein the cut-away hole 212 is formed. The fixed plate 211 is employed to prevent the hollow shaft 120 of the disperser 100 from emerging up to the water surface during the use of the disperser 100.

A worker may engage the disperser 100 to the upper surface of the central plate 210 and may position the hollow shaft 120 of the disperser 100 below the central plate 210 via the cut-away hole 212 and then may engage the fixed plate 211, whereby air can be dispersed in water in a state where the hollow shaft 120 is not emerged out of the water.

More specifically, a connection member 250, the vertical cross section of which is formed in a shape of ⊓, is engaged to the upper surface of the central plate 210, and the driving motor 110 of the disperser 100 is installed operable at an end portion of the connection member. When a user uses the disperser 100, the hollow shaft 120 of the disperser 100 is rotated downwards to be submerged in water and then is used.

Meanwhile, a plurality of rods 220 are engaged in a radius direction to the central plate 210. A plurality of the rods 220 are arranged in a radial shape, and the floating body 230 is engaged to an end portion of the rod 220.

The floating body 230 is a float which is made of a Styrofoam, a plastic material, etc. and is able to float on liquid. It can be manufactured in various shapes, for example, a cylindrical shape, a quadrangular box shape, a conical shape, etc. In the present inventive concept, it is preferably made in a water drop shape.

As illustrated in FIG. 15, the floating body is formed of a water drop shape, the vertical cross section of which is formed in a shape of ◊. A rod insertion hole 231 is formed horizontally at an upper portion of an outer circumference of the floating body 230, and the rod 220 is inserted in the rod insertion hole 231, so the floating member 230 can be engaged to the central plate 210.

Moreover, a connection cap 240 is engaged to the top of the floating body 230. The connection cap 240 is engaged to the top of the floating body 230 in such a way to cover the top of the floating body 230.

The lower portion of the connection cap 240 is formed open for the same of easier mounting on an upper outer circumference of the floating body 230, and the vertical cross section thereof is formed in a trapezoid shape.

Furthermore, a hollow hole 241, which is passing through from top to bottom, is formed at an upper surface of the connection cap 240, wherein the top of the floating body 230 can pass through the hollow hole 241. A rod mounting groove 242 is formed at an upper surface in order for the rod to be inserted into the road mounting groove 242, and the rod mounting groove 242 is formed crossing the hollow hole 241.

Referring to FIG. 13, the rod 220 is mounted at the rod mounting groove 242 of the connection cap 240 and is inserted in the rod insertion hole 231 of the floating body 230 which is engaged passing through the hollow hole 241 of the connection cap 240, and a bolt is engaged passing through both the rod 220 and the connection cap 240, whereby the rod 220, the connection cap 240, and the floating body 230 can be fixedly engaged.

As illustrated in FIGS. 20 to 22, according to an example of the central plate 210, the guide plate 213 is engaged horizontally side by side to the top of the central plate 214, and the guide plate 213 is engaged spaced apart at a predetermined interval from the top of the central plate 214.

Moreover, a plurality of support rods 214 are engaged vertically between the central plate 210 and the guide plate 213, thus supporting the guide plate 213.

Furthermore, the driving motor 110 is fixed at the upper surface of the guide plate 213. Since the driving motor 110 is fixed at the upper surface of the guide plate 213, the hollow shaft 120 of the disperser 100 cannot rotate, whereby it is possible to enhance any stability when in use of the float tie for the disperser 100 according to the present inventive concept.

In addition, according to an example of the support rod 214, the support rod 214 is length-adjustable. The support rod 214 may include, but is not limited to, a support rod body having a space inside thereof, and a length adjusting rod which is inserted in the space of the support rod body and, thus, length-adjustable.

A plurality of tightening nut holes are formed in the lengthwise direction of the rod at the outer circumferences of the support rod body and the length adjusting rod. Tightening nuts are inserted passing through the tightening nut holes of the support rod body and the length adjusting rod and are tightened, whereby the support rod body and the length adjusting rod can be fixed.

More specifically, the submerged length of the hollow shaft 120 of the disperser 100 in water can be adjusted in such a way that the user inserts the length adjusting rod into the inside of the support rod body or separates it in the lengthwise direction of the support rod body. For this reason, the float tie for the disperser 100 and the disperser 100 according to the present inventive concept can be used at a shallow water area.

Moreover, according to another example of the length-adjustable support rod, a predetermined section of the support rod is formed of a flexible part. The length of the support rod can be adjusted in such a way that the user pulls upwards the flexible part, if necessary, or presses it downwards.

In the flexible part, a plurality of taper-shaped members are continuously engaged. The length can be adjusted since the aforementioned members are folded or unfolded. Since a fold type door (a folding door), a flexible hose, etc. are known and are being widely used, the detailed description thereon will be omitted.

The user is able to bend the flexible part, if necessary, so as to adjust the inclination of the hollow shaft 120 of the disperser 100, so air can be dispersed in a predetermined area.

The fixing rod is engaged detachable to an outer circumference of the flexible part, thus preventing the flexible part from bending due to the weights of the central plate 210 installed at the top of the support rod 214 and the disperser 100. The fixing rod is formed in a rod shape and is engaged to an outer circumference of the flexible part by using a tightening member, for example, a bolt, a nut, etc., so it can be detachable.

As described above, the disperser according to the present inventive concept has a simplified configuration, and a water suction force via a suction port is good since a central portion of a lower guide wing is formed concave when viewed from the top, and the central portion becomes a vacuum state with the aid of centrifugal force during the rotation of a guide wing, and the guide wing can be easily attached and detached, and the fluid discharged from the impeller can be dispersed upward or downward or up to a near or distant area, and applicability on site can be maximized.

The inventive concept has been described in detail with reference to preferred embodiments thereof. However, it will be appreciated by those skilled in the art that changes may be made in these embodiments without departing from the principles and spirit of the inventive concept, the scope of which is defined in the appended claims and their equivalents.

What is claimed is:

1. A disperser, comprising:

a driving motor;

a hollow shaft, one end portion of the hollow shaft is connected to the driving motor and is configured to be rotated by the driving motor; and an impeller which is disposed on an opposite end portion of the hollow shaft and is employed to discharge air to the outside of the disperser;

a rotary joint connecting the one end portion of the hollow shaft to the driving motor, wherein the impeller includes a circular plate-shaped body having a plurality of wings at a lower surface thereof, and an upper circular plate-shaped guide wing and a lower circular plate-shaped guide wing disposed at the upper and lower portions of the body, respectively, and a plurality of suction ports formed through the lower circular plate-shaped guide wing, the edges of the upper circular plate-shaped guide wing and the lower circular plate-shaped guide wing are bent at predetermined angle toward the circular plate-shaped body.

2. The disperser of claim 1, wherein the rotary joint includes a hollow rotation body to which an upper end portion of the hollow shaft is connected and a fixed body which surrounds an outer surface of the rotation body, and through holes formed to pass through inner centers of the rotation body and the fixed body.

3. The disperser of claim 2, the predetermined angle is from about 25° to about 30°.

4. The disperser of claim 3, wherein a center of the lower circular plate-shaped guide wing has a concave shape when viewed from the top.

5. The disperser of claim 4, further comprises a floating device connected to the driving motor by a connection member.

6. The disperser of claim 5, the floating device comprises:

a central plate connected to the connection member;

a plurality of rods connected to the central plate; and a floating body connected to the plurality of rods.

7. The disperser of claim 6, wherein the central plate includes a central hole formed at a center of the central plate.

8. The disperser of claim 6, wherein the central plate further includes a cut-away hole extending from the central hole to an edge of the central plate.

9. The disperser of claim 5, the floating body further comprises:

a rod insertion hole form on a top portion of the floating body; and a connection cap having a rod mounting groove, the connection cap being disposed on a top portion of the floating body.

10. The disperser of claim 6, the floating device further comprises:

a guide plate connected to the central plate by supporting rods.

11. The disperser of claim 6, the floating device further includes a fixing plate connected to the central plate to fix the hollow shaft not to detach from the central plate.

12. The disperser of claim 1, further comprising an engaging member connecting the hollow shaft to an auxiliary hollow shaft.

* * * * *